United States Patent [19]

Wokas

[11] Patent Number: 4,788,802

[45] Date of Patent: Dec. 6, 1988

[54] PREBUILT EXTERIOR ROOM

[76] Inventor: Albert L. Wokas, 22245 Thorofare, Grosse Ile, Mich. 48138

[21] Appl. No.: 40,745

[22] Filed: Apr. 17, 1987

Related U.S. Application Data

[63] Continuation of Ser. No. 393,786, Jun. 30, 1982.

[51] Int. Cl.[4] ..... E04H 1/00

[52] U.S. Cl. ..... 52/79.1; 52/34

[58] Field of Search ..... 52/34, 35, 79.1, 79.2, 52/79.3, 79.4, 79.5, 79.6, 79.7, 79.8, 79.9, 79.11, 79.12, 79.13, 79.14

[56] References Cited

U.S. PATENT DOCUMENTS

| | | | |
|---|---|---|---|
| 455,128 | 6/1891 | Sparks | 52/34 |
| 1,739,622 | 12/1929 | Wallace | 52/34 |
| 2,644,203 | 7/1953 | Donahue | 52/34 |
| 3,110,907 | 11/1963 | King | 52/79.1 |
| 3,162,863 | 12/1964 | Wokas | 52/79.1 |
| 3,378,964 | 4/1968 | Erickson | 52/79.13 |
| 3,466,818 | 9/1969 | Van Der Lely | 52/79.13 |
| 3,585,767 | 6/1971 | Wilk | 52/79.1 |
| 3,593,469 | 7/1971 | Wall | 52/79.1 |
| 3,620,246 | 11/1971 | Shoquist | 52/34 |
| 3,694,973 | 10/1972 | Unger | 52/79.1 |
| 3,717,964 | 2/1973 | Brown et al. | 52/79.1 |
| 3,762,112 | 10/1973 | Evans et al. | 52/79.8 |
| 3,805,467 | 4/1974 | McCrillis et al. | 52/79.1 |
| 3,831,327 | 8/1974 | McCrillis et al. | 52/79.1 |
| 3,862,534 | 1/1975 | Coletti | 52/79.1 |
| 3,913,286 | 10/1975 | Boutacoff | 52/79.1 |
| 3,990,197 | 11/1976 | Johnston | 52/79.1 |
| 4,027,439 | 6/1977 | Willard | 52/79.1 |
| 4,071,984 | 2/1978 | Larrow | 52/79.1 |
| 4,221,441 | 9/1980 | Bain | 52/79.1 |
| 4,439,957 | 4/1984 | Raasakka et al. | 52/79.1 |

*Primary Examiner*—Michael Safavi

[57] ABSTRACT

A transportable prebuilt room forming module for external attachment to the exterior of a building comprises an inner box defining a room and an outer box spaced from the inner box and defining an enclosure and risers and insulation between the two boxes and rigidly interconnecting them, the inner box including a sandwich type floor member interconnecting the walls of the room and a reinforced roof member also interconnecting the walls of the room.

15 Claims, 3 Drawing Sheets

PREBUILT EXTERIOR ROOM

This is a continuation of application Ser. No. 393,786, filed June 30, 1982, now abandoned.

BRIEF SUMMARY OF THE INVENTION

The invention relates to prebuilt rooms in the form of modules that can be factory built and transported to the site of installation. In particular, the invention concerns rooms that are to be added externally to existing home by attachment to the outside of a wall of the building.

It is the purpose of the invention to provide a module that by external attachment will provide an additional room for a building and that is more cost effective than "stick building" of a comparable room.

The invention accomplishes this purpose and other objectives by means of strong inner room providing box, which in preferred form makes effective use of standard size 4'×8' building components such as plywood sheets, sheet rock, bond board, etc. and of standard size lumber such as 2"×4", etc. The inner room providing box is spaced within and rigidly secured by risers, etc. to an outer enclosure and this plus a floor panel member and a roof panel member that are rigidly affixed at the bottom and top of the inner box give the module sufficient strength and rigidity in all directions so that it can be transported and installed even after the room is completely finished on the inside to suit the tastes and requirements of the user. Preferably, special frames at the top and bottom of the module rigidly interconnect the floor panel and roof panel members with the outer enclosure.

The present invention which is primarily for retrofit purposes is different in structure and concept from the invention described in my U.S. Pat. No. 3,162,863, entitled "Prefabricated Bathrooms and Prefabricated Restrooms", which is primarily a core for a building structure.

Figure 1:
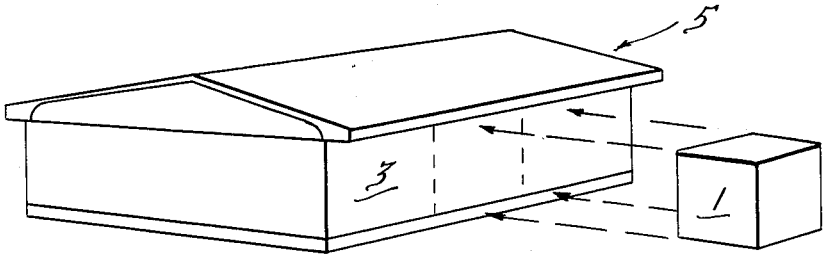
FIG. 1 is a schematic perspective view of a prebuilt transportable module according to the invention just prior to external installation on a residence.

In the drawings, the module 1 is utilized to provide a bathroom that may be attached to the rear wall 3 of a residence 5. Bathrooms are probably the primary applications of the invention, but it may be used to provide kitchens, nurseries, or other types of rooms for addition to the outsides of existing dwellings.

For the sake of economy, simplicity, and efficiency of construction, it is highly preferred that the module be constructed around the basic horizontal-interior dimensions of 4' deep and 8' wide and the basic vertical dimension of substantially 8' high. Sheets of plywood, drywall, sheet rock, bond board, and insulation are manufactured and sold in the standard size of 4'×8', and by following the principles of the invention they may be utilized "as is", or as supplied, in the module 1 without the need for reduction in size.

Figure 5:
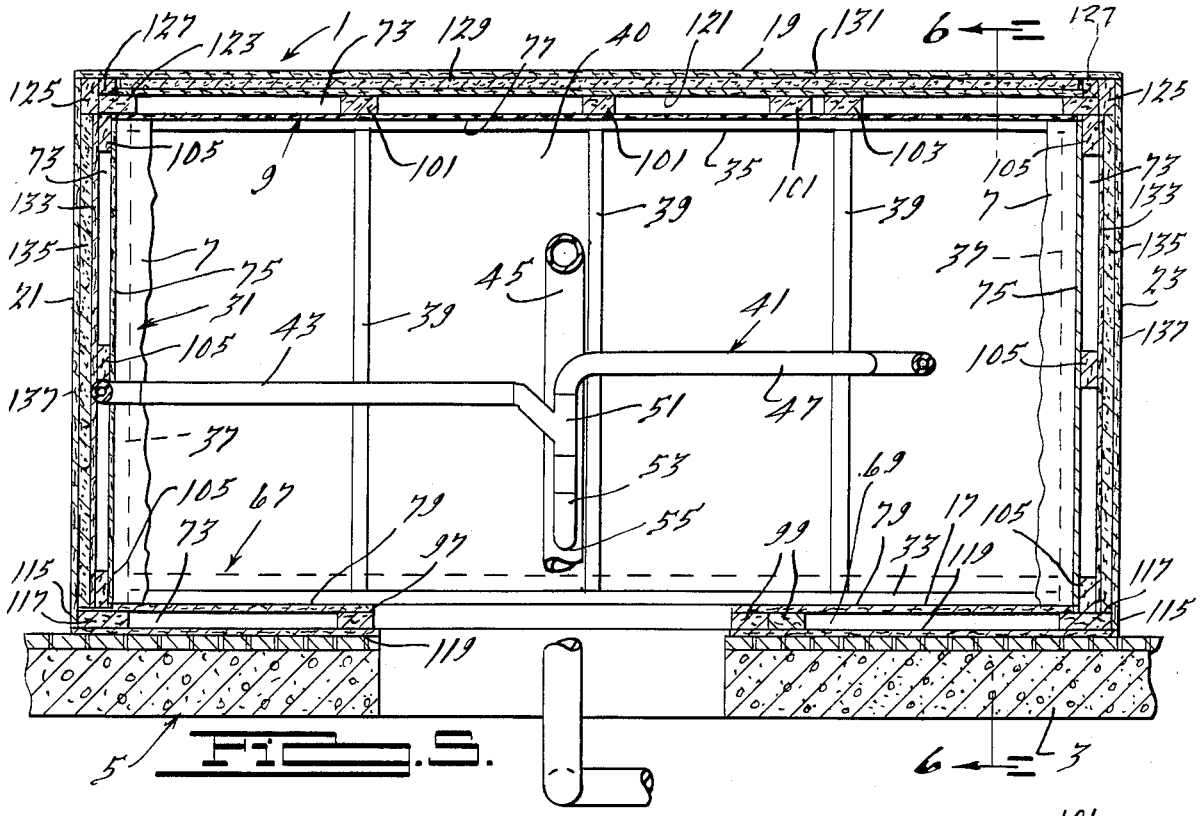
FIG. 5 is a horizontal cross section, with parts omitted or broken away, along the line 5—5 of FIG. 3.

Thus, the basic floor 7 of the room 9 which is provided by module 1 is a 4'×8' sheet of plywood as seen best in FIG. 5. Since the module illustrated is a bathroom, the room 9 contains a vanity 11, (including sink, mirror, light, cabinets, etc.), a toilet 13 and a shower stall 15 (which could instead be a bathtub), all of which can be purchased separately, selected to suit the tastes or requirements of the user, and installed at the factory when the module 1 is built so that it is only necessary to hook them up to plumbing and electrical systems at the site where the module is attached to the exterior of the house 5.

Figure 2:
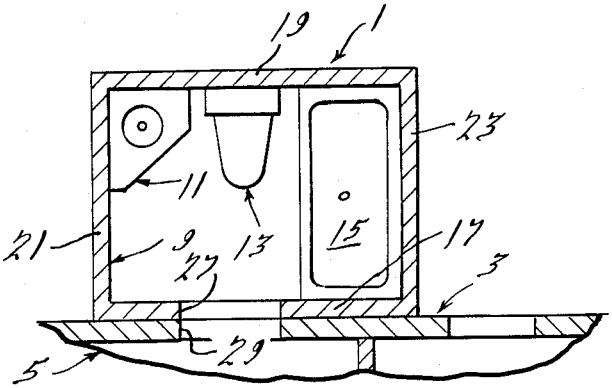
FIG. 2 is a schematic horizontal cross section, with parts broken away and out of proportion, through the module of FIG. 1 after installation on a residence.

Many different floor plans can be utilized, the plan shown in FIG. 2 being one to facilitate use by handicapped persons confined to wheelchairs.

In addition to the floor 7, the module has a front wall 17 which engages the wall 3 of the residence and a rear wall 19 which is spaced from wall 17 by the sidewalls 21 and 23. The module is covered on top by a roof 25. The front wall 17 has a doorway 27 in it which is aligned with a doorway opening 29 formed in house wall 3 prior to attachment of the module to the residence. The size of the doorway 27–29 can vary as desired. For example it may be standard or it may be enlarged to facilitate use by handicapped persons confined to wheel chairs. A door of a suitable type (not shown) is hung in the doorway after installation of the module.

A major component of the module is a sandwich-type floor panel subassembly member 31 which has, as its uppermost elements, a 4'×8'×¾" plywood sheet providing the floor 7. The plywood sheet is rigidly secured by nails or the like to front and rear joists 33 and 35 which are parallel to front and rear walls 17 and 19 and to transverse end joists 37 and intermediate transverse joists 39 which extend between and are rigidly secured to the joists 33 and 35 by nails or the like. The joists are preferably 2"×10" standard size wood lumber or, as shown in the drawings, they can be formed from 2"×6" wood boards to form the 2"×10" dimension. The overall horizontal size of the framework provided by the joists 33, 35, 37 and 39 is 4'×8', i.e., the same as plywood sheet forming floor 7. While it can be done in other ways, this size is achieved in the member 31 by use of transverse end joists 37 that are 4' long, front and rear joists 33 and 35 that fit between end joists 37 and are 8' long less the combined widths of joists 37 (about 3"), and transverse intermediate joists 39 that fit between the front and rear joists and are 4' long less the combined widths of the front and rear joists 33 and 35 (about 3"). The sandwich of member 31 is completed by a bottom 4'×8'×½" plywood sheet 40 that is rigidly secured by nails or the like to the joists 33, 35, 37, and 39.

Before the member 31 is nailed together, a plumbing tree 41, meeting code requirements, is mounted inside the member 31. It may include, for example, a 2" branch 43 to carry waste from vanity sink 11, a 3" branch 45 to carry waste from toilet 13, and a 2" branch 47 with trap 49 to carry waste from shower 15. The branches 43 and 47 are illustrated as coupled at 51 to a conduit 53 which is coupled to the larger branch 45 at 55, the latter therefore serving as a common outlet conduit for all branches. It is adapted to be connected to the sewer system of residence 5. Suitable openings are formed in the floor 7 and the various joists to receive and support the tree 41. The branch 43 has an elbow 57 that projects through an end joist 37 for subsequent connection during assembly of wall 21 to a vertical conduit 59. It is adapted to be coupled at 61 to the outlet 63 of the sink in vanity 11, there also being a clean-out coupling 65 shown in the conduit 59 and adapted to project through wall 21 into the bathroom 9.

Also, before the member 1 is nailed together but after the plumbing tree 41 is in place, the empty space in the sandwich is filled with suitable insulating material 66, preferably glass fibers.

In accordance with the invention, a peripheral wooden frame 67, similar to a picture frame, is rigidly fastened, as by nails or screws, all around the bottom of the floor panel member 31. The frame 67 comprises front and rear 2"×6" boards 69 and left and right side 2"×6" boards 71, all of which are securely attached to the bottom plywood sheet 40 and the bottoms of the various joists 33, 35, 37, and 39. The inner edges of the frame boards 67 and 69 are located so that the outer horizontal flange-like portions 73 of the boards, which extend outwardly of the 4'×8' panel cross section project just the right distance to provide the desired thickness to the various walls 17, 19, 21, and 23. This is about 3½" for walls 19, 21, and 23 and may be somewhat less (as illustrated about 1½") for front wall 19 which, being flush against the house wall 3, does not require as much insulation as the other three walls.

The innermost element of each end wall 21 and 23 is shown as a 4'×8'×½" layer 75 of sheet rock (or plywood or drywall) which is rigidly fastened at its bottom by nails or the equivalent to the outer face of the respective transverse end joist 37. The innermost element of the rear wall 19 is a pair of side-by-side layers 77 of 4'×8'×½" sheet rock (or drywall or plywood) which are rigidly fastened at their bottom ends to the ends of floor joists 37 and to the rear floor joist 35. The innermost element of the front wall is a pair of side-by-side layers 79 of 4'×8'×½" sheet rock (or drywall or plywood) which are appropriately cut out to provide the opening for doorway 27 and which are also rigidly fastened at their bottom ends to the ends of joists 37 and the outer face of front joist 33. The various layers 75, 77, and 79 all engage at their bottom ends the flange portions 73 of the peripheral frame 67.

The top ends of the sheets 75, 77, and 79 are securely fastened to the outer faces of 4'×8' roof panel 81 which fits like a cork in the top of the inner box provided by the sheets. This comprises a 4'×8'×178" sheet of plywood 82 which is rigidly secured by nails or the like to the top edges of 2"×4" roof joists. These joists comprise front and rear joists 83, left and right end transverse joists 85, and intermediate transverse joists 87, all of which are rigidly fastened to each other and to the sheet 82 in substantially the same way that has been described for the floor panel 31. A top frame 89, similar to a bottom frame 67, is rigidly fastened to the various roof joists and has a flange-like portion 91 that sits on the top end edges of the 8 foot wall panels 73, 77, and 79 and on other parts to be described. The frame 89 comprises a front 2"×2" board (FIG. 4) 92 and a rear 2"×4" board 93 and also left and right side 2"×4" boards 95. The narrow side of each of the boards 93 and 95 and a side of board 92 is engaged with the outer faces of the roof joists 83 and 85 and arranged so that the flat top dimension is flush with the top surface of the plywood sheet 82, i.e., the boards 92, 93, and 95 preferably extend about ½" above the top surfaces of the joists 83 and 85 as indicated best in FIG. 4 and not so well in FIG. 3. The boards 93 and 95 are rigidly secured to the roof joists by means of nails or the like. The actual width of a 2"×4" board is 3½" and this corresponds with the 3½" width of the flange-like portion 73 on the bottom frame 67 insofar as walls 19, 21, and 23 are concerned. The actual width of board 92 corresponds to the 1½" width of flange 73 for the front wall 17 as previously mentioned.

Figure 3:
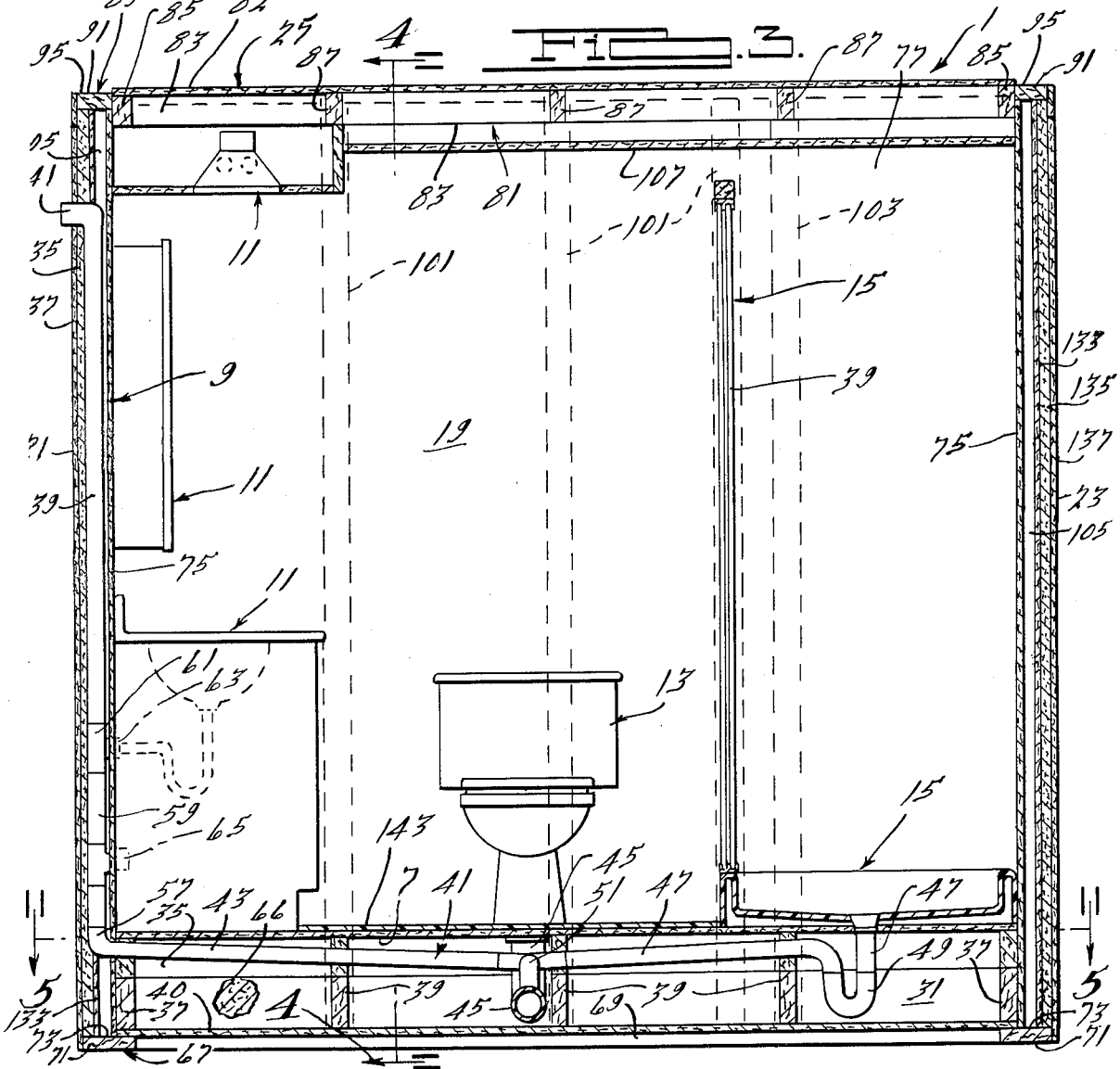
FIG. 3 is a vertical cross section looking away from the residence through the module of FIG. 2, and is somewhat schematic, inlet water piping and electrical wiring, for example, being omitted.

As seen best in FIGS. 3 and 5, the various walls also include vertically extending risers or studs comprising 2"×4"×8' wooden boards. Thus, the wall 17 has a riser 97 on one side of the doorway 27 and a pair of risers 99 on the opposite side of the doorway. The rear wall 19 has three risers 101 and a fourth riser 103 in alignment with the shower doorway mechanism 39. The sidewalls 21 and 23 each have three risers 105. The flat or wide part of each of the risers 97, 99, 101, 102 and 105 (i.e., the nominal 4" and actual 3½" dimension) engages the adjacent panel 75, 77 or 79 and is rigidly secured to it by nails or the like. The bottom ends of the risers engage the flanges 73 of the bottom frame 67 and the top ends fit against the bottom face of flange 91 of the top frame 89. The various boards 92, 93, and 95 forming the top frame 89 are rigidly secured by nails or the like to the top ends of the risers 97, 99, 101, 103 and 105. Likewise, the various boards 69, 71, and 73 forming the bottom frame 67 are rigidly secured by nails or the like to the bottom ends of the risers 97, 99, 101, 103 and 105.

Preferably, a drop ceiling 107 is added inside the bathroom 9, below the roof panel member 81, and this may include an offset section 109 for the light fixture 111. Insulation 113 (FIG. 4), preferably glass fibers, is used in the space between the drop ceiling and the roof panel 81 to inhibit heat loss.

Figure 4:
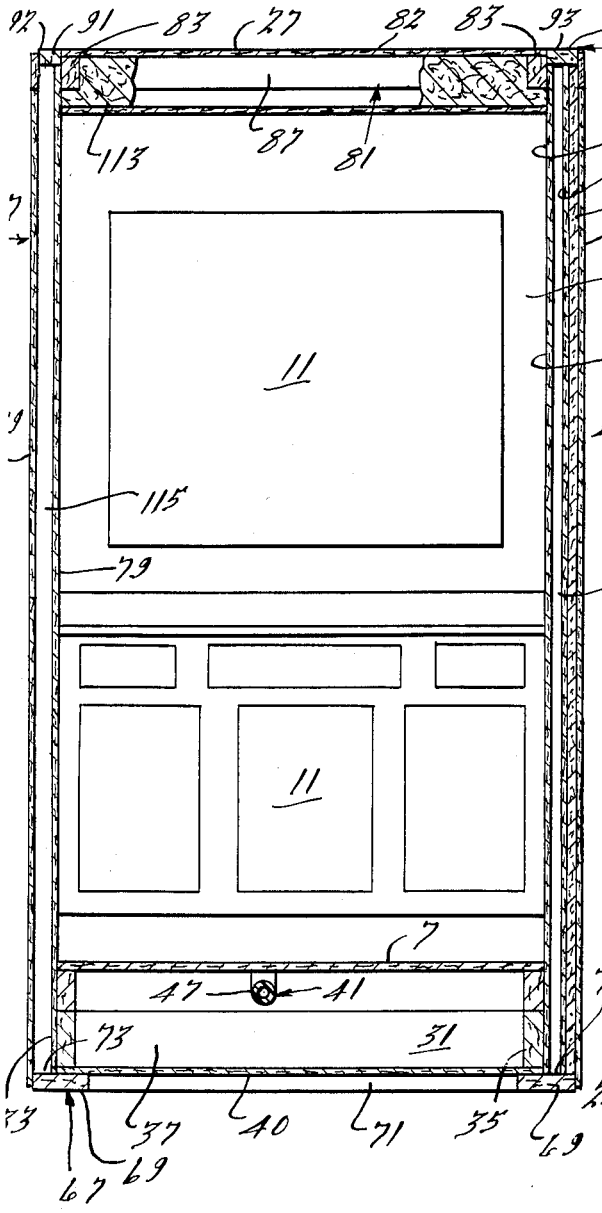
FIG. 4 is a vertical cross section, with some parts omitted or simplified, taken along line 4—4 of FIG. 3.

As seen best in FIGS. 4 and 5, the front wall 17, includes a pair of 2"×6"×8' risers 115 at its two corners and these are rigidly nailed to risers 105 and to floor end joists 37 and to the roof frame 89. They have projecting flange-like portions 117 which extend 3" beyond the outside faces of the ½" sheet rock panels 75. Thus, their outer end edges are aligned with those of bottom frame flange 73. The outermost layer of front wall 17 is provided by ½" sheets of plywood 119 that are rigidly nailed to the risers 115, 97, and 99 and to the bottom frame board 69 and the roof frame board 92. The plywood sheets 119 engage the wall 3 of the residence 5 when the module 1 is installed.

The rear wall 19 requires more insulation than the front wall 17 and for this purpose a pair of side-by-side ½"×4'×8' bond board panels 121 are rigidly nailed to the outer faces of risers 101 and 103 and to 2"×4"×8' corner risers 123 that correspond to the 2"×6" risers 115 in the front wall. They project the thickness of risers 105 (i.e. 1½") beyond the outer faces of sheet rock panels 75 and are rigidly nailed along their lengths to the edges of the risers 105 to form angle-shaped or L-shaped members rigid with the rear vertical corners of the room 9. A 2"×4"×8' riser 125 has its flat side rigidly nailed along its length to the end edge of each of the risers 123, as seen best in FIG. 5. The risers 125 project 1½" to the rear of the outer faces of the risers 123. In the corners between risers 123 and 125 are located 2"×2"×8' (actual dimensions 1½"×1½") risers 127 which are rigidly nailed to risers 123 and 125 along their lengths so that the horizontal distance between the inside vertical faces of the risers 127 is 8' whereby two of the 4' side panels 121 fit side-by-side between them. The flange 73 of bottom frame 67 and the flange 91 of the top frame 89 are rigidly secured by nails or the equivalent to the various risers 123, 125, and 127, as well as to the other risers.

Also fitting between the inside vertical faces of the risers 127 in rear wall 19 are two side-by-side 1"×4"×8' panels 129 of insulation board that are rigidly nailed through panels 121 to the risers 101, 103 and 123. Finally, ½" plywood sheets 131 parallel to and coextensive with front outside sheets 119 are rigidly secured by nails or the like through panels 121 and 129 to risers 101, 103 and 123 and to risers 125 and 127 which they engage. They are rigidly nailed also across their widths to the edges of bottom flange 73 and top flange 91 which they engage.

Insulation of the two sidewalls 21 and 23 is preferably identical and substantially the same as that of the rear wall 19. Thus, in each sidewall there is a ½"×4"×8' panel 133 of bond board rigidly nailed along its length to the various risers 105. Next to it is a 1"×4"×8' panel 135 of insulation board, its outer face being flush with the end edges of risers 115 and 125 as well as the end edges of bottom frame flange 73 and top frame flange 91. It is rigidly secured through panel 133 by nails or the like along its length to the risers 105. A sheet of ½" plywood 137 is next to panel 135 and is nailed through it and panel 133 along its length to the studs 105. It is also nailed along its length to risers 115 and 125 which it engages along its vertical edge portions and along its width to the end edges of top frame flange 91 and bottom frame flange 72 which it engages along its horizontal edge portions.

Wall 21 differs from wall 23 in the module 1 in having certain plumbing components in it. Conduit 59 has already been described. There is also a vent conduit 139 coupled at 61 to the conduit 59 and having an elbow portion 141 at its top end which extends outwardly through suitable openings in the wall layers to open outside the module. While it fits primarily in the air space between risers 105, appropriate cutouts can be made in panels 133 and/or 135 to accommodate it. Thus, the module can be thought of as comprising an inner box provided by panels 75, 77, which is strengthened at opposite ends by the floor panel 31 and the roof panel 81. Further strength is provided by the various intermediate panels and risers as well as by an outer enclosure secured thereto as provided by plywood sheets 119, 131, and 137 (and trim strips used to enlarge them to suit beyond the 4'×8' size) and their rigid interconnection through top and bottom frames 67 and 89 to the panels 31 and 81 and inner box.

The module 1 is very strong and sturdy with torsional rigidity in all three planes. It is capable of being transported by truck, rail, or plane for many miles from the place of manufacture to a place of storage and/or a place of application, such as residence 3. Before this is done, however, it is contemplated that the interior of the module, i.3. the room 9, will be finished off completely to suit the order of the purchaser and/or potential user. Thus, the fixtures 11, 13, and 15 are installed and tied in to the plumbing and electrical service installed in the module. The interior walls can be wall papered, painted, tiled, plastered, or covered as desired. Floor tile as indicated at 143 can be laid over the plywood floor 7. In short, the room 9 can be in a ready-to-use condition when the module 1 is shipped from the factory, awaiting only installation on a house and hook-up to the electrical and plumbing facilities of the house. Either at the factory or at the site, appropriate external trim can be added to the outside of the box, such as shingles, siding, roofing, or paint, to enable it to blend in aesthetically with the building on which it is installed.

Figure 6:
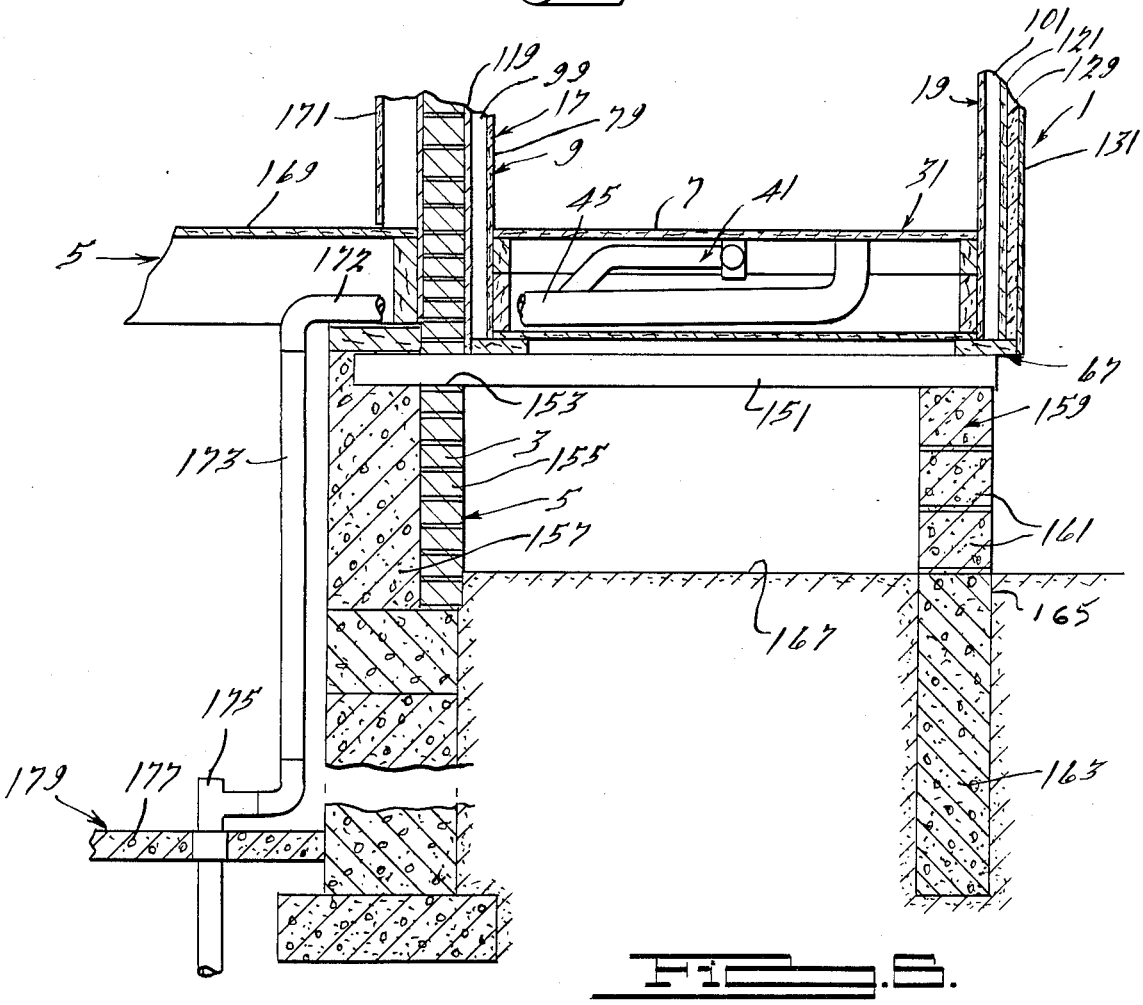
FIG. 6 is a vertical cross section, with parts omitted and simplified, along the line 6—6 of FIG. 5 and shows a bathroom module installed on a residence.

One means of installation is illustrated in FIG. 6. A pair of laterally spaced beams 151 have their inner ends supported in apertures 153 that are formed in the brick siding 155 and concrete foundation 157 of the wall 3 of building 5. The outer end of each of the beams 151 rests on top of a column 159 of concrete block 161 which is supported on a concrete foundation 163 poured into a suitable opening 165 in the ground 167 behind the house 5.

The vertical level of the tops of beams 151 is selected and adjusted (as by shims or the like) so that the top surface of floor 7 is on exactly the same level as the top surface of the floor 169 in the room 171 in which the doorway 29 (FIG. 2) has been formed. Suitable bridging (not shown) from floor 7 to floor 169 is installed at the bottom of the doorway 29. This will accommodate a connector conduit 172 to be coupled to the outlet 45 of the plumbing tree 41. In the installation illustrated, the connector 132 is attached to the top of a vertical pipe 173 near the foundation wall 157 which at its bottom end is tied in to a clean-out 175 on the floor 177 of the basement 179 of the house 5.

After installation of module 1, it will usually be desirable to leakproof the joint between the walls 3 and 17 and this can be accomplished in any suitable manner. Also, as previously indicated, it may be desired to alter the appearance of the exterior of the module in some way to match, blend with, or complement the appearance of the dwelling 5.

Figure 7:
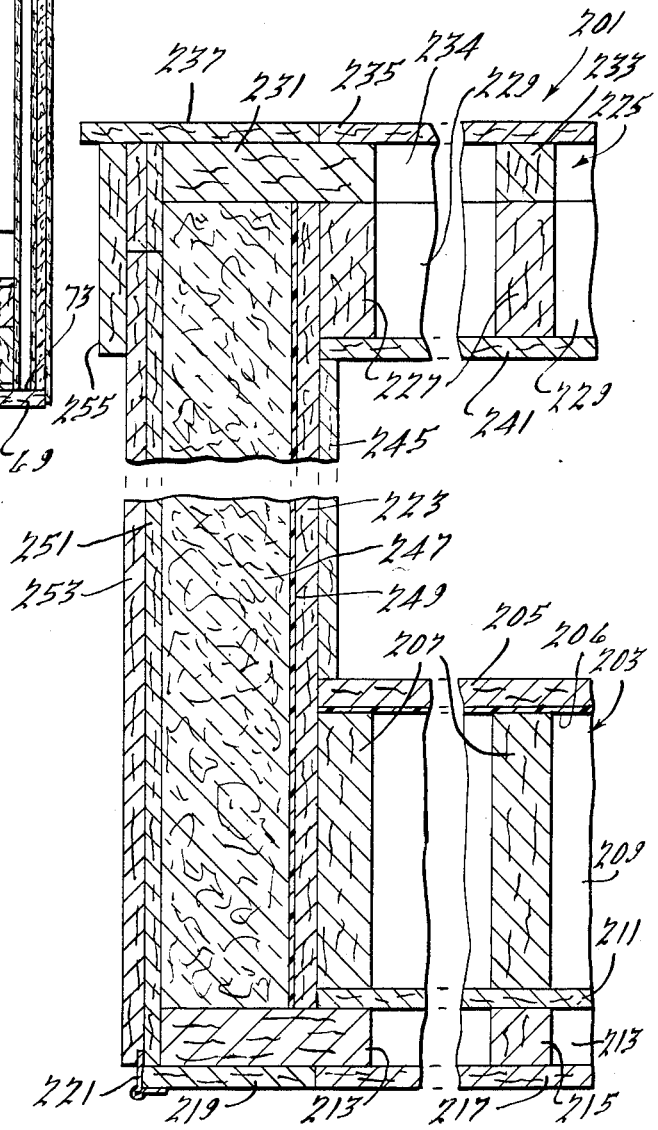
FIG. 7 is a vertical cross section, broken away, of a modified form of module embodying the invention.

Referring to FIG. 7, a modified module 201 is illustrated in which certain risers are turned so that their flat dimension is perpendicular to the wall panels instead of flat against them as in the previous embodiment. Also the sandwich-type floor panel has been changed a little and a plywood sheet has been added at the bottom of the module to present a substantially flat surface, as distinct from the surface presented by the "picture frame" bottom 67 of the module 1.

In the module 201, the sandwich floor panel 203 has a top element 205 in the form of a ¾"×4'×8' sheet of plywood which may have vapor seal material 206 on its bottom surface. It is rigidly secured by nails or the like to 2"×8" transverse joists 207 that themselves are rigidly nailed at opposite ends to front and rear joists 209 that are also 2"×8". At the bottom of the joists 207 and 209, is a ½"×4'×8' sheet of bond board 211 which is rigidly nailed to the various joists. Secured to the bottom of the layer 211 is the bottom "picture" frame 213, corresponding to frame 67, and comprising 2"×6" boards which have the inner peripheral portions rigidly nailed through the panel 211 to the joists 207 and 209. The flange-like frame 213 extends around the entire rectangular periphery and projects out 4" in the rear and two sidewalls and 2" on the front wall from the edges of board 211, similar to the frame 67.

Rigidly secured to intermediate transverse parts of the floor panel 211 are a series of 2"×2" joists 215 which have bottom surfaces that are coplanar with the bottom surface of the frame 213. A bottom layer 217 of ½"×4'×8' plywood is rigidly nailed to the frame 213 and to the various joists 215 to form the bottom surface of the module. Since the outside surface of the module is somewhat larger than the 4'×8' dimension, four ½" plywood filler strips 219 are placed around the periphery of the plywood panel 217 so that the entire bottom surface of the module is relatively flat. Thus, the module box can be moved on rollers or otherwise handled with minimum possibility of interference or hang-up due to a non-flat bottom surface.

The flange member 211 shown in the drawing is actually a metal drip edge which is applied at the site after installation of the module.

In a manner similar to the module 1, the basic interior wall of the module is provided by a series of ½"×4'×8' plywood panels 223. These vertically extending panels 223 suit the 4'×8' shape of the floor sandwich 203. They are rigidly secured by nails or the like to the floor sandwich 203 at their bottom ends and at their top ends they are rigidly secured to a top roof panel 225. This comprises a framework of transverse 2"×4" joists 277 which extend between front and rear 2"×4'×8' joists 229 and are rigidly nailed to them. On the top of the outer two of joists 227 and along the length of the front and rear joists 229 are 2"×6" boards forming a top flange-like frame 231 which is rigidly nailed to the joists and has a flange portion projecting out 4" (and 2" in the front) corresponding to the projection of bottom frame 213. On top of intermediate transverse joists 227 are a series of 2"×2" transverse joists 233 which fit inside the frame 231 as indicated at 234 and are rigidly secured in place on joists 227. The top surface of the module 201 comprises a ½"×4'×8' sheet of plywood 235 that is rigidly nailed to the frame 231 and to the joists 233 and 234. If desired, a rectangular arrangement of four ½" plywood filler strips 237 may be arranged around the periphery of the sheet 235 and nailed to the top of the frame 231 as illustrated.

If desired, a ½"×4'×8' panel of sheet rock 241 may be nailed to the bottoms of the joists 227 and 229 to form the ceiling of the room formed by module 201. Vapor seal material (not shown) may be applied to the top surface. Insulation (not shown) may be used to fill the space in the top panel 225 between the sheet 241 and the sheet 235.

Also, if desired, the interior walls of the room may be provided by ½"×4' wide panels of sheet rock 245 of suitable length which are laid over and nailed to the panels 223 and to the risers 247 behind them.

The risers 247 correspond to the risers 97, 99, 100, 103 and 105 of the module 1 but are turned 90° so that they are on edge with respect to the panels 223. They are 2"×4'×8' studs to which at their top and bottom ends are rigidly nailed or attached to the frames 231 and 213 respectively. The spaces (not shown) between adjacent risers 247 may be filled with insulation (not shown), preferably fiberglass. A vapor barrier 249 may be applied to the back surfaces of panels 223 which are in contact with the insulation.

The outer vertical surfaces of the module as shipped are provided by ½" plywood panels and strips 251 which are nailed rigidly along their lengths to the various risers 247, as well as horizontally along their top and bottom edges to the edges of the frames 213 and 231.

The front wall (not shown) of module 201 can be constructed in the same manner as wall 17 of module 1 since it can be thinner and the on edge risers 247 are not needed to give added thickness and insulating properties of the wall.

FIG. 7 illustrates siding boards 253 attached to the panels 251 and trim strips 255 attached to the siding boards 253. In the usual case these will be applied at the site to give an exterior appearance to the module compatible with that of the house on which it is installed.

As indicated above, the rooms inside the modules 1 and 201 can be of practically any type. While I anticipate that bathrooms are the primary application because of the many existing homes whihc need additional bathroom facilities, the modules can just as easily be prebuild to provide ready-to-use kitchens, nurseries, dressing rooms, libraries, recreation rooms, offices, etc. A wide variety of floor plans can be used. Doors and windows (not shown) can be positioned to suit. The modules can be of particular value to provide by retrofit rooms to assist the elderly, infirm, and handicapped.

Additionally, more than one module can be used. For example, a first module can be secured to a house and then a second module installed flush against it, the two modules having connecting doorways. Even a third module can be added flush against the second. The first module could, for example, be a dressing room (opening off a bedroom in the house) and the second a bathroom such as provided in module 1. Even a complete apartment can be created by adding a kitchen and bathroom modules off the bedroom of a house, preferably with a dressing room module added also.

While in a broad sense the modules can be made of nonstandard size materials, I definitely prefer the use of standard 4'×8' sheets, 2"×4", 2"×8" boards, etc. as described above. An important reason for this is based on the economics of the housing industry. If non-standard parts are used they are, initially at least, more expensive due to waste, if nothing else. Also, if close delivery dates are to be met either they or full modules must be kept in inventories of substantial size. This ties up capital, credit, or cash before orders are received and leads to serious financial difficulties if sales do not materialize. Since the modules 1 and 201 are designed to be made from common standard parts, it is not really necessary to have them on hand. They can be purchased quickly after orders are received; or, if purchased beforehand, they can be returned since they are still standard parts. Thus, a minimum amount of money is tied up in the business of producing the modules and, as a consequence, the business is on a sounder financial basis than one using odd size module materials.

As already indicated various modifications in what has been illustrated are within the spirit and scope of the invention. For example, metal extrusions may be used instead of 2"×4" wood boards for risers, and other substitutions could be made for the specific materials described.

I claim:

1. A prebuilt transportable module providing a room to be secured externally to the wall of an existing building, said room having front and rear walls, left and right sidewalls, a ceiling and a floor, said module comprising a sandwich type floor member, said floor member having a rectangular framework of front and rear joists and transverse joists including end joists extending between the front and rear joists, said floor member having plywood panels covering the top and the bottom of the rectangular frame work and rigidly secured to the joists, said module also comprising vertical front wall and rear wall and sidewall members each including vertical inner wall forming plywood panels having bottom portions overlapping and rigidly secured to sides of said front and rear joists of said floor member and the end transverse joists of said floor member, said module further comprising a roof member having a rectangular framework of front and rear joists and transverse joists including end joists extending between the front and rear joists, said roof member having a plywood panel covering the top of said framework and rigidly secured thereto, said vertical inner wall forming panels having upper portions overlapping and rigidly secured to sides of the front and rear and end transverse joists of said roof member, said vertical inner wall forming panels extending substantially the full heigh of the module and forming an inner box strengthened at opposite ends by rigid attachment of said bottom portions and said upper portions respectively to said floor member and said roof member, said vertical members including vertical risers rigidly secured to the outside surfaces of said vertical inner wall forming panels, and outer enclosure forming sheets rigidly secured to said risers to form an outer box around and rigidly connected to the inner box, said sheets being structural load carrying elements, means rigidly interconnecting said sheets to said roof member and to said floor member, said boxes and the respective vertical inner wall forming panels and enclosure sheets thereof carrying loads on the module and providing strength and sturdiness with torsional rigidity in all three planes for the module.

2. A module as provided in claim 1 including a rectangular frame means rigidly secured to said floor member at the bottom thereof and providing a flange extending outwardly from the front and rear and end transverse joists thereof, said risers and said outer enclosure sheets being rigidly secured to said flange.

3. A module as provided in claim 1 including a rectangular frame means rigidly secured to said roof member at the top thereof and providing a flange extending outwardly from the front and rear and end transverse joists thereof, said risers and said outer enclosure sheets being rigidly secured to said flange.

4. A module as provided in claim 3 including a rectangular frame means rigidly secured to said floor member at the bottom thereof and providing a flange extending outwardly from the front and rear and end transverse joists thereof, said risers and said outer enclosure sheets being rigidly secured to said floor flange.

5. A module as provided in claim 1 including a plumbing tree supported inside the floor member on said joists and having at least one branch opening into said room, said tree having an outlet opening through the front of said floor member and above the bottom of the module for connection to the plumbing system of the building to which the module is attached.

6. A module as provided in claim 5 including bathroom fixtures mounted in said room and having waste outlets, said plumbing tree having branches connected to said waste outlets.

7. A module as set forth in claim 1 including vertical insulation panels in said rear wall member and said sidewall members coextensive with the vertical wall forming panels thereof and rigidly secured to said risers on sides thereof opposite to sides on which the vertical wall forming panels are attached, said insulation panels being inside of said outer enclosure forming sheets and overlapping said floor and roof members.

8. A module as set forth in claim 7 wherein said risers are rectangular and flat against said vertical panels.

9. A module as set forth in claim 7 wherein said risers are rectangular and on edge against said vertical panels.

10. A module as set forth in claim 7 wherein all said panels except the panels in the front wall member are the same size and said size is a standard commercially available size.

11. A module as set forth in claim 10 wherein said standard size is 4′×8′.

12. A module as set forth in claim 11 wherein said risers are 2″×4″ in cross section.

13. A module as set forth in claim 12 wherein said floor member has a rectangular frame means rigidly secured thereto providing flanges extending substantially 3½″ outwardly from the rear joist and the end transverse joists and substantially 1½″ from the front joists, said risers being rigidly secured to said flanges.

14. A module as set forth in claim 13 wherein said roof member has a rectangular frame means rigidly secured thereto providing flanges extending substantially 3½″ outwardly from the rear and the end transverse joists and 1½″ from the front joist, said risers being rigidly secured to said roof flanges.

15. A module as provided in claim 2 including a wooden panel attached to the frame means and forming the bottom surface of the module and whereby said bottom surface is substantially flat and uninterrupted by openings of a size to interfere with movement of the module on rollers engaging the bottom surface and supporting the weight of the module.

* * * * *